United States Patent [19]

Dayet et al.

[11] 4,114,004

[45] Sep. 12, 1978

[54] GAS-BLAST ELECTRIC CUT-OUT DEVICE

[75] Inventors: Jacques Dayet, Lyon; Joseph Martin, Villeurbanne; Charles Nicola, Meyzieu, all of France

[73] Assignee: Delle-Alsthom S.A., Villeurbanne, France

[21] Appl. No.: 727,750

[22] Filed: Sep. 29, 1976

[30] Foreign Application Priority Data

Oct. 9, 1975 [FR] France ..... 75 30996

[51] Int. Cl.[2] ..... H01H 33/88

[52] U.S. Cl. ..... 200/148 A

[58] Field of Search ..... 200/148 A, 148 R

[56] References Cited

U.S. PATENT DOCUMENTS

| | | | |
|---|---|---|---|
| 3,839,613 | 10/1974 | Tsubaki et al. | 200/148 A |
| 3,985,988 | 10/1976 | Korner et al. | 200/148 A |

*Primary Examiner*—Robert S. Macon

*Attorney, Agent, or Firm*—Sughrue, Rothwell, Mion, Zinn and Macpeak

[57] ABSTRACT

A gas-blast circuit-breaker comprises arcing contacts provided with nozzles of the same diameter, operating means ensuring an original movement of a mobile one of the arcing contacts in the opposite direction to that of the mobile main contact at the opening of the device.

11 Claims, 3 Drawing Figures

GAS-BLAST ELECTRIC CUT-OUT DEVICE

FIELD OF THE INVENTION

The invention relates to electric switching apparatus such as circuit-breakers or switches in which the arc which occurs between the arcing contacts during cut-out is extinguished by a blast of gas, e.g., sulphur hexafluoride, compressed by an auto-compression device.

DESCRIPTION OF THE PRIOR ART

The search for high efficiency in such a device has lead to the provision of a temporary covering of the fixed and mobile contacts during the compression of the gas at the beginning of contact opening. Generally, this disposition results in the use of gas flow cross-sections which differ between the fixed side and the mobile side and consequently to an assymmetrical blast which can be unfavorable to the extinction of the arc.

SUMMARY OF THE INVENTION

Preferred embodiments of the present invention provide a symmetrical blast across a pair of identical arcing contacts in the form of nozzles during cut-out.

The present invention provides an electric cut-out device comprising two main contacts and two secondary arcing contacts one of each kind of contact being fixed and the other being mobile. Means are provided for compressing a blast gas used for extinguishing the arc which forms between the arcing contacts. Both of the arcing contacts are tubular and provided with nozzles having the same diameter and manoeuvring means are arranged to ensure when the output device opens, a first movement of the mobile arcing contact in the opposite direction to the movement of the mobile main contact until the mobile arcing contact occurs presses against the fixed arcing contact, then the mobile arcing contact is held in this position as long as the main contacts are not separated from each other and lastly, a second movement of the mobile arcing contact, in the same direction as the mobile main contact occurs, a short time after the separation of the main contacts.

Preferably, the blast gas compression means has two mobile parts modifying a compression volume provided for the gas. A first of the mobile parts is integral with the mobile main contact and the second of the mobile parts which moves at the beginning of the opening movement of the cut-out device in the opposite direction to that of the mobile main contact. The cut-out device includes a drive device which temporarily makes the said second mobile part and the mobile arcing contact more together without slipping.

Most of such apparatus is described in published French patent application No. 7,500,326 for an auto-compression circuit-breaker, while the drive device is preferably constituted by a brake setting up friction between the second mobile part and the mobile arc cut-out contact.

When a device according to the invention opens, the short-circuit current is switched from the main contacts to the fixed and mobile arcing contacts by putting these latter in contact with each other after the beginning of the opening action of the main contact but before the separation of the main contacts. On closing, to avoid any danger of fusion between the nozzles of the two arcing contacts when they come into contact with each other, the pre-firing and the generating of the short-circuit current are effected advantageously between the fixed cut-out arc contact and an auxiliary closing arc contact having a larger diameter than that of the tube supporting the mobile opening arcing contact, and disposed so as to be between the two cut-out arc contacts at the instant when the device closes.

An embodiment of the invention will now be described, by way of example, with reference to the accompanying drawings.

DESCRIPTION OF THE PREFERRED EMBODIMENT

Figure 1:
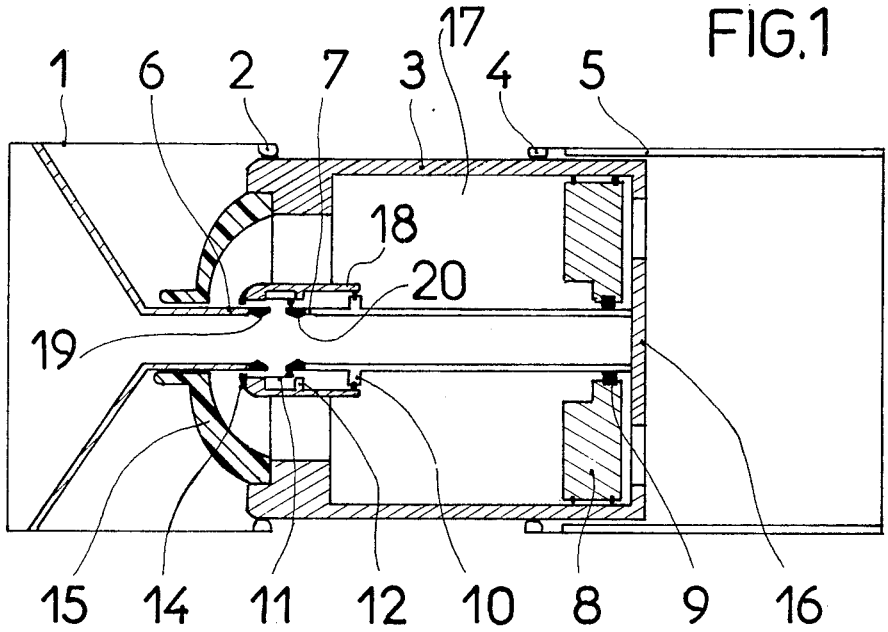
FIG. 1 is a schematic cross-section of the contacts of a circuit-breaker in the closed position.

In the closed position of the switch of the present invention, FIG. 1, current passes through a fixed part 1, fixed main contact fingers 2, a mobile blast cylinder 3 (which constitutes a mobile main contact tube), sliding contact fingers 4 and a support 5 for the mobile part 3. A fixed arcing contact 6 and a mobile arcing contact 7, are provided in the form of nozzles 19 and 20 of the same diameter, and are arranged to part after the main contacts have parted.

Figure 2:
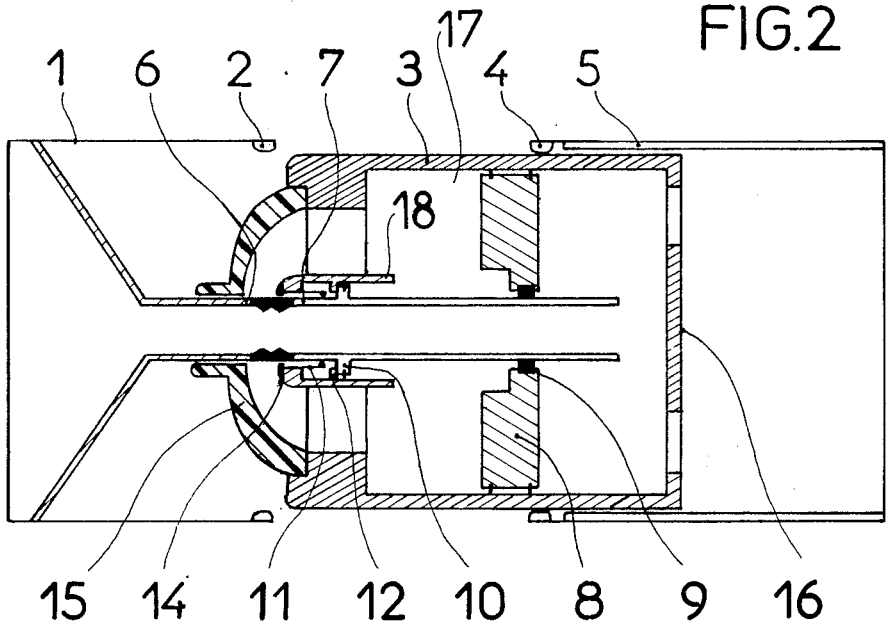
FIG. 2 is a sectional view similar to FIG. 1, but showing the circuit-breaker in a half-way position with the main contacts parted and the secondary arcing contacts still closed.
Figure 3:
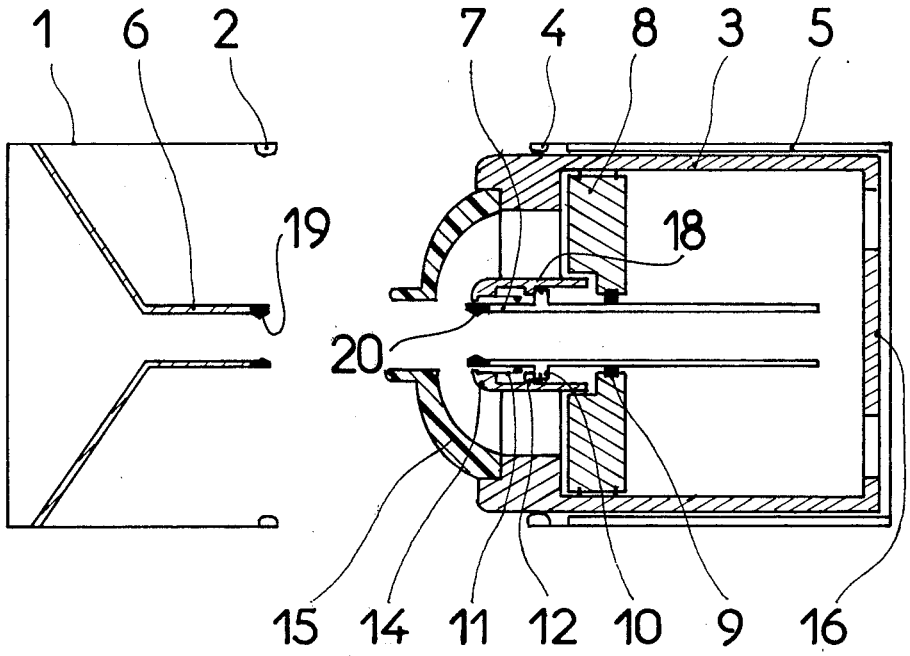
FIG. 3 is a sectional view similar to FIGS. 1 and 2 but showing the circuit breaker in the open position.

At the beginning of opening, operation units, (not shown), here as they are described elsewhere, move two mobile parts in opposite directions: a piston 8 moves towards the left and the cylinder 3 forming the main mobile contact moves towards the right, so as to compress a blast gas which is in a compression space 17, defined by these two mobile parts. Initially, under the action of a drive device 9 (e.g., a friction force provoked by a brake), the mobile arcing contact 7 follows the movement of the piston 8. The movement of the contact 7 continues under the action of a resultant force F which is the sum of the force provided by the drive device temporarily preventing the mobile arcing contact 7 and the piston 8 from sliding relative to each other and from the force corresponding to the application of the gas pressure on an auxiliary piston formed by a flange 10 borne by the mobile arcing contact 7 and sliding in a sleeve 18 integral with the cylinder 3 also constituting the main mobile contact. The mobile arcing contact 7 thus presses against the fixed arcing contact 6 and the force pressing the two contacts 6 and 7 together, is the force F. When the fingers 2 of the main fixed contact part from the mobile contact tube 3, the current passes through the arcing contacts 6 and 7, through the fingers of an auxiliary contact 11 integral with the mobile contact tube 3, through the sleeve 18 and the tube 3 itself and finally through the fingers of the sliding contact 4. A short time later, the flange 10 comes into contact with a first stop 12 integral with the mobile contact tube 3 and borne by the sleeve 18 and the mobile arcing contact 7 is driven towards the right by the mobile main contact tube 3 (position shown in FIG. 2). The arc is set up between the arcing contacts 6 and 7 and is blown out by the blast gas which passes through the duct formed between a closing arc contact 14 borne on the sleeve 18 and an insulating nozzle 15 integral with the mobile main contact 3; the mobile piston 8 then stops and starts again in the same direction as the contact cylinder-tube 3 which it meets at the end of the opening (position shown in FIG. 3).

At the beginning of closing (FIG. 3), the mobile contact tube 3 moves towards the left and the piston 8 moves towards the right. The mobile arcing contact 7 is initially driven by the piston 8 under the action of the drive device 9 until it presses against a second stop 16 integral with the mobile contact tube 3, then the contact 7 is driven by the stop 16 of the mobile contact tube 3 together with the piston 8 whose direction of movement is reversed.

As the length of the mobile arcing contact tube 7 is shorter than the distance separating the closing contact arc 14 of the stop 16, the current will be pre-fired and set up between the fixed arcing contact 6 and the closing arc contact 14, before the mobile contact tube 3 comes into contact with the fingers 2 of the main fixed contact. The friction drive device 9 prevents the arcing contacts 6 and 7 from coming into contact with each other. At the end of the closing, the contact-breaker is again in the disposition shown in FIG. 1.

What we claim is:

1. An electric cut-out device comprising:

a main fixed contact, a main mobile contact, a fixed arcing cut-out contact, a mobile arcing cut-out contact, means for compressing a blast gas used for extinguishing the arc which forms between the arcing contacts upon cut-out operation, said arcing cut-out contacts being tubular and being provided with nozzles opposing each other for contact therebetween and being of the same diameter, means for maintaining said arcing cut-out contacts open when said main contacts are closed prior to cut-out device cut-out operation, and maneuvering means for effecting when the cut-out device opens, a first movement of the mobile arcing cut-out contact, in the opposite direction to the movement of the mobile main contact and towards said fixed arcing cut-out contact, until the mobile arcing cut-out contact presses against the fixed arcing cut-out contact, then holding of the arcing cut-out contacts closed as long as the main contacts are not separated from each other, and lastly, a second movement of the mobile arcing cut-out contact, in the same direction as the mobile main contact, a short time after the separation of the main contacts.

2. A cut-out device according to claim 1, wherein the blast gas compression means comprises two mobile parts defining a compression volume provided for the gas including a first mobile part being integral with the mobile main contact and a second mobile part movable at the beginning of the opening movement of the cut-out device in the opposite direction to that of the mobile main contact, and said maneuvering means includes a drive device for temporarily causing said second mobile part and the mobile arcing cut-out contact to move in unison without slipping to cause said arcing cut-out contacts to close prior to separation of the main contacts.

3. A device according to claim 2, wherein the drive device is constituted by a brake setting up friction between the second mobile part and the mobile arcing contact.

4. A cut-out device according to claim 2, wherein the tubular mobile arcing cut-out contact comprises a radial flange, said mobile main contact comprises a sleeve, said flange slides within said sleeve and constitutes an auxiliary piston which is subjected to the pressure of the gas of the compression volume such that its action is added to that of the drive device during the first movement of the mobile arcing cut-out contact and during the holding of the mobile arcing cut-out contact against the fixed arcing cut-out contact.

5. A cut-out device according to claim 4, wherein a first stop integral with the mobile main contact effects the second movement of the mobile arcing cut-out contact.

6. A device according to claim 5, wherein the first stop is borne by the sleeve and contacts the flange of the mobile arcing cut-out contact.

7. A device according to claim 1, further including a mobile closing arcing contact in addition to and having a larger diameter than said mobile arcing cut-out contact and being concentrically disposed about and lying between the two arcing cut-out contacts when the cut-out device closes, so that during closing, the current is initially set up between the fixed arcing cut-out contact and the mobile closing arcing contact.

8. A device according to claim 7, wherein the mobile closing arcing contact is borne by the sleeve.

9. A device according to claim 8, wherein the mobile opening arcing contact is driven, in the closing direction, by a second stop integral with the mobile main contact.

10. The cut-out device according to claim 2, wherein said first mobile part comprises a cylinder concentrically surrounding the mobile arcing cut-out contact, said second mobile part constituting an annular piston slidably mounted within said cylinder for axial movement with respect thereto and wherein said drive device comprises a friction brake bearing on the outside of said tubular movable arcing cut-out contact and supporting said tubular arcing cut-out contact for independent axial movement relative to said piston and said cylinder.

11. The cut-out device according to claim 4, wherein said first mobile part comprises a cylinder, said second mobile part comprises an annular piston mounted within said cylinder for axial sliding movement, said sleeve is coaxially fixedly mounted to said cylinder at one end thereof with said flange slidably received therein so as to slidably support one end of said tubular movable arcing cut-out contact and said annular piston slidably receives the portion of tubular moving arcing cut-out contact to one side of said flange such that said movable tubular arcing cut-out contact is movable axially independently of said piston and said cylinder, a friction brake carried by said annular piston and bearing on the outside of said tubular movable arcing cut-out contact.

* * * * *